US006302279B1

(12) United States Patent
Robolin

(10) Patent No.: US 6,302,279 B1
(45) Date of Patent: Oct. 16, 2001

(54) IN-STORE REAR LOADABLE DISPLAY ARRAY

(75) Inventor: Claude J. Robolin, Lavonia, GA (US)

(73) Assignee: RHC/Spacemaster, Lavonia, GA (US)

( * ) Notice: Subject to any disclaimer, the term of this patent is extended or adjusted under 35 U.S.C. 154(b) by 0 days.

(21) Appl. No.: 09/137,341

(22) Filed: Aug. 20, 1998

(51) Int. Cl.[7] ..... A47F 1/04
(52) U.S. Cl. ..... 211/59.2
(58) Field of Search ..... 211/59.2, 162, 211/94.01

(56) References Cited

U.S. PATENT DOCUMENTS 5,119,944 * 6/1992 Milton ..... 211/59.2
5,476,180 * 12/1995 Konstant ..... 211/59.2
5,524,776 * 6/1996 Hall et al. ..... 211/59.2
5,595,311 * 1/1997 Allen ..... 211/59.2
5,617,961 * 4/1997 Konstant et al. ..... 211/59.2
5,871,108 2/1999 White .

* cited by examiner

*Primary Examiner*—Alvin Chin-Shue
*Assistant Examiner*—Sarah Purol
(74) *Attorney, Agent, or Firm*—Robert I. Conte; Lee, Mann, Smith, McWilliams, Sweeney & Ohlson

(57) ABSTRACT

An in-store product display area gondola array for positioning between a pair of parallel aisles and an end aisle and arranged for rear loading. An end cap rack is moveable away from a row of two or more fixed racks into the end aisle to provide loading access of the end cap rack from the rear. The fixed racks are disposed between the parallel aisles, face one of the parallel aisles and mount a row of two or more moveable racks facing the other of the parallel aisles. A pocket adjacent the end cap is aligned with the row of moveable racks to receive one of the moveable racks to provide access to the rear surface of a fixed rack for rear loading thereof.

18 Claims, 5 Drawing Sheets

IN-STORE REAR LOADABLE DISPLAY ARRAY

BACKGROUND OF THE INVENTION

Traditionally, display and end cap racks and gondolas used in supermarkets and like facilities are filled from the front. A drawback of this is that there is no assurance that the first merchandise placed on the gondolas will be the first merchandise removed by a customer. This frequently results in older stock remaining on the gondolas. To eliminate that possibility when restocking a gondola, everything must be removed from the front, following which new merchandise must be moved to the rear and the older merchandise reloaded from the plant. This presents obvious drawbacks and frequently results in customers purchasing inventory that is not up to date because the steps necessary to assure rotation are not taken. In turn, this can result in the loss of customer satisfaction and the permanent loss of customers who are dissatisfied with the quality of the merchandise they have purchased.

Typical merchandise aisles, such as in supermarkets, have display rack or gondola arrays which are fixed in position. The arrays are typically positioned between two parallel aisles which intersect a transverse end aisle. Thus, the gondola arrays typically include an end cap facing the transverse end aisle and one or more gondolas extending between the parallel aisles which terminate at the end cap. Consumers can select merchandise from the end cap when in the end aisle and from the front of the other gondolas when in the other aisles. It is arrays such as this which must be loaded from the fronts of the gondolas because there is no available alternative.

Back loading is known, but only in arrays of refrigerated cabinets and the like, such as those used for milk display and dispensing. In those cases, the shelving is accessible to customers from an aisle, via a door or like opening in the cabinets. In such an arrangement, the shelving can be loaded with fresh merchandise from a storage area behind the cabinets and shelving. Customers obviously can gain access to the merchandise from the aisle, but there is no customer access either from another parallel aisle or from the end of an end cap array, the latter because there is no end cap.

It would be desirable to provide a rack and gondola system from which customers passing down two adjacent parallel aisles and through an associated transverse aisle providing an end cap may select merchandise, while permitting the filling of the gondola system and the end cap from the rear to assure first-in, first-out selection of merchandise by customers. This will produce a system in which there will be greater assurance of merchandise rotation, less in-store loading and restocking time, and which interferes only minimally with customer activity.

SUMMARY OF THE INVENTION

In accordance with the present invention, an in-store product display area rack array adapted to be located at the end of a row of display racks and positioned between a pair of first and second parallel aisles and a third end aisle perpendicular to the parallel aisles is provided. The aisles are used by customers for selecting merchandise from the front surfaces of racks located on opposite sides of the aisles.

The display area rack array comprises a first fixed rack for storage and display of merchandise, the first rack having a front display surface facing a first aisle, a parallel rear surface adapted to be exposed to a second adjacent parallel aisle and side surfaces which are generally perpendicular to the rear and front surfaces, a second end cap rack for storage and display of merchandise, the second rack being mounted adjacent to and moveable relative to the first rack, the second end cap rack having a front display face facing the third end aisle, the second end cap display rack having a rear face which is generally parallel to the third end aisle and which is parallel to and closely adjacent to one of the side surfaces of the first rack, the second end cap display rack being moveable between a first position in which the rear face and the one side surface of the first rack are closely adjacent and a second position in which the rear face and the one side surface are spaced apart a distance sufficient to allow a person to freely enter the space therebetween and to load the second end cap rack with merchandise from the rear face, and a third rack for storage and display of merchandise, the third rack being mounted adjacent to and moveable relative to the first rack, the third rack confronting the rear surface of the first rack and facing the second aisle and moveable away from the rear surface to expose the rear surface to allow a person to load the first rack with merchandise from the rear surface of the first rack, the three storage and display racks constituting a unitary rack array comprising a display area in a first display mode and defining an open loading area behind the end cap rack in a second loading mode.

In a most-preferred form, the display rack assembly includes a fixed pocket adjacent the end cap rack and in line with the third rack and positioned to receive the third rack when it is moved to expose the rear surface of the first rack.

Desirably, the rack array includes means for mounting the second and third racks for movement in directions parallel to the first and second aisles. In another form, the rack array includes means for mounting at least one of the second and third racks for pivotal movement about corners of the second and third racks. At least one of the second and third moveable racks is supported on rollers supported on the floor of the display area.

In a preferred form, roller means are provided for mounting the first and third racks to each other, whereby the third rack may roll from a first position confronting the rear surface of the first display rack to a second position in which the rear surface is exposed to the second aisle to permit loading of the first rack with merchandise from the rear surface thereof.

The display rack array may desirably further comprise a plurality of the first fixed racks arrayed in a row, each having a rear surface, and a plurality of the third moveable racks arrayed in a row for movement in a direction parallel to the rear surfaces of the first racks.

In a most-preferred form, the display rack array includes roller means mounted on the first and third racks for rollingly supporting the third racks on the first racks for rolling movement away from the first rack rear surfaces to expose the rear surfaces to allow loading of the first racks with goods from the rear surfaces of the first racks. Desirably, the roller means comprise a track mounted on the first racks and rollers mounted on the third racks.

Further objects, features and advantages of the present invention will become apparent from the following description and drawings.

DETAILED DESCRIPTION

Figure 1:
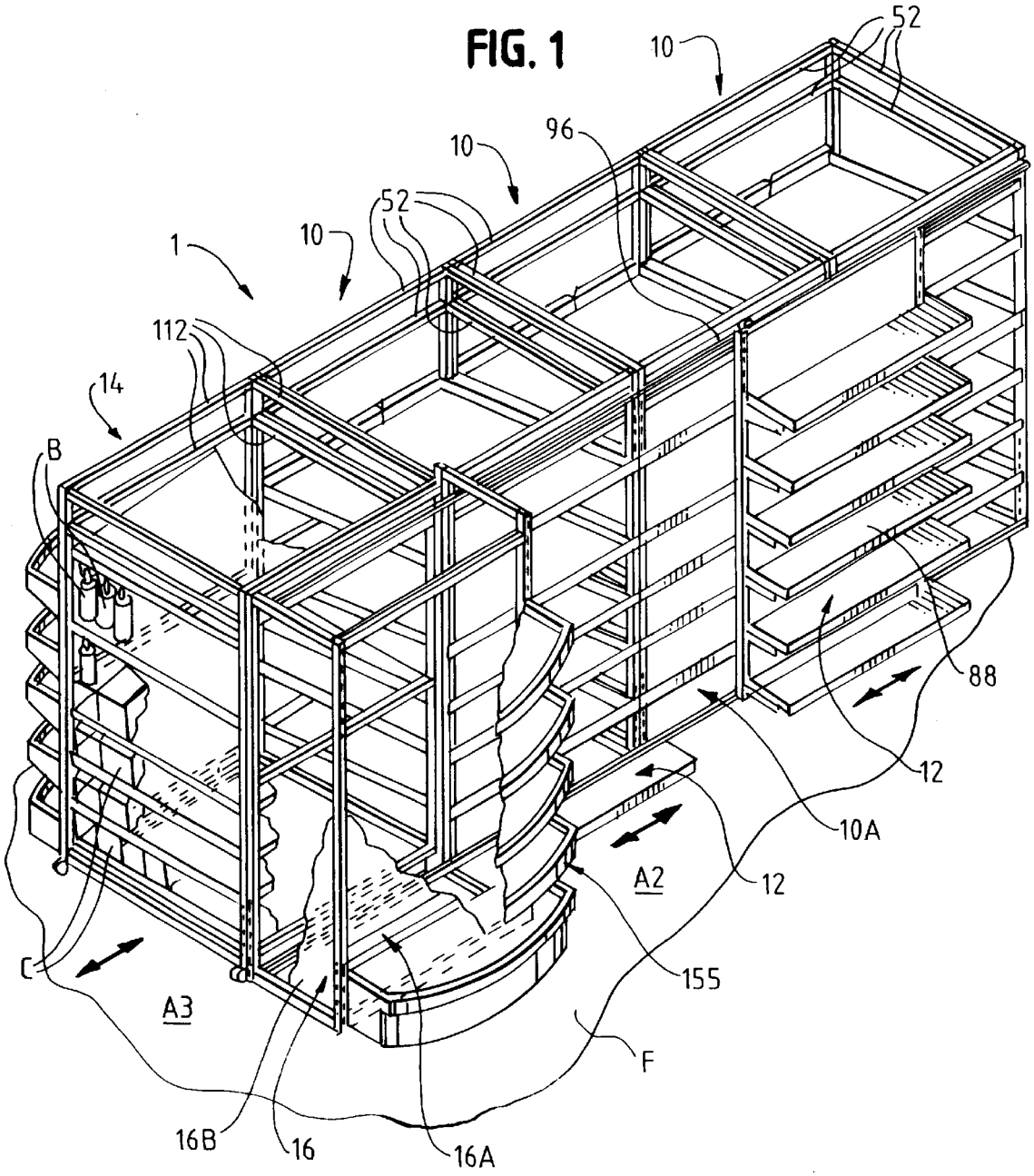
FIG. 1 is a top perspective of an in-store merchandise display area array including an adjacent end cap in accordance with the present invention.

Referring now to FIGS. 1–12, an in-store product display area array 1 at the end of a row is disposed between a pair of first and second customer accessible parallel aisles A1 and A2 and at a third end aisle A3 which is generally transverse to the first and second aisles A1 and A2. The product display area comprises one or more first fixed display gondolas 10, a display gondola 12 positioned at the rear of each fixed display gondola 10 and which is moveable relative to the associated display gondola 10, and an end cap gondola 14 adjacent to one of the fixed display gondolas 10. End cap gondola 14 is moveable relative to the fixed display gondola 10. Display gondolas 10 and 12 face outwardly adjacent their confronting aisles A1 and A2, respectively; end cap gondola 14 faces outwardly adjacent aisle A3. All of the gondolas are supported on a base or floor F.

In a preferred form a fixed pocket 16 is provided adjacent end cap gondola 14. Pocket 16 is dimensioned and positioned to temporarily nestingly receive an adjacent display gondola 12. Pocket 16 faces aisles A3 and A2. Pocket 16 is hollow, and one or both of its aisle facing walls 16A and 16B may be used as display surfaces or may be provided with racking or the like for merchandising purposes, as wall 16A is shown by FIG. 1 and as shown in FIG. 2 in dotted line to illustrate the fact that such racking is optional.

Figure 2:
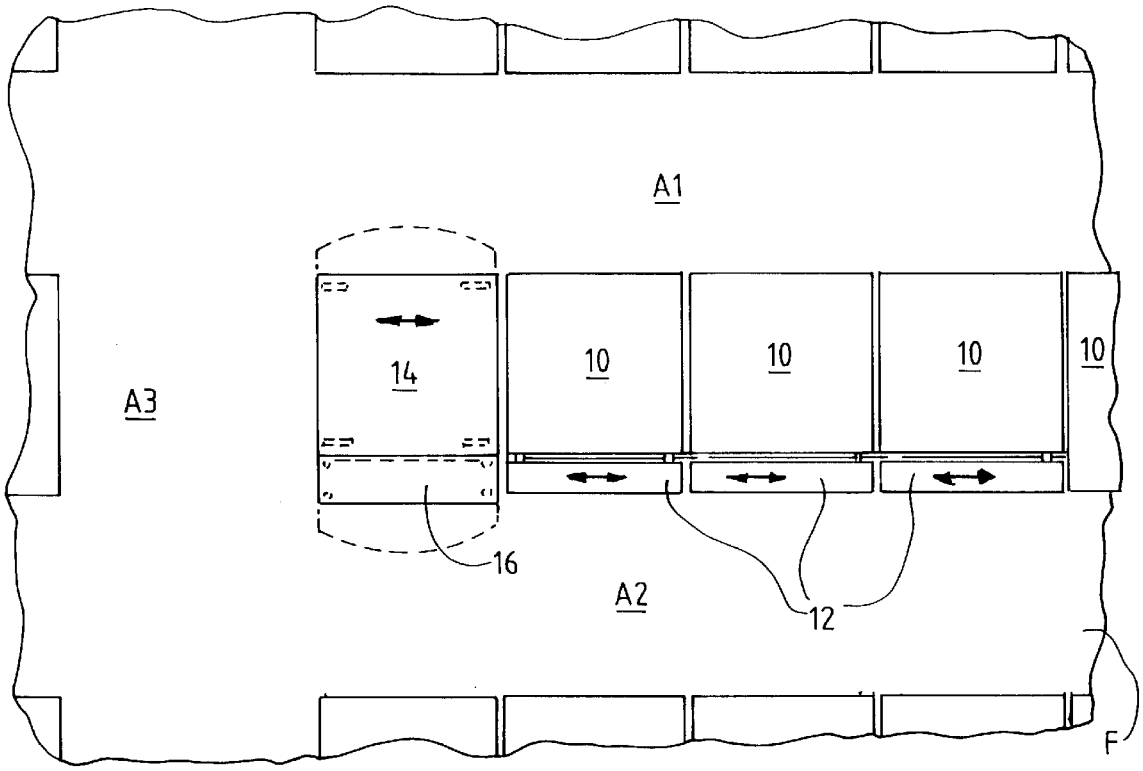
FIG. 2 is a schematic plan view of the merchandise display area array of FIG. 1 and its environment.
Figure 3:
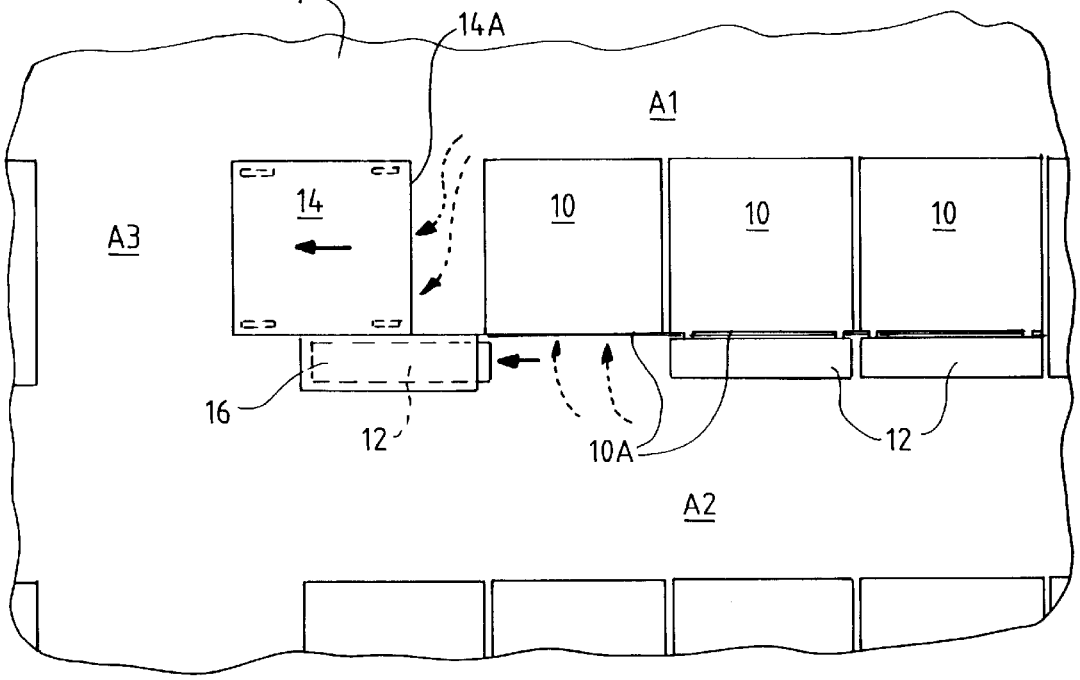
FIG. 3 is a plan view like FIG. 2, but in an open rear loading orientation.

As illustrated by FIGS. 2 and 3, the end cap gondola 14 is supported for rolling reciprocating movement, as in the direction of parallel aisles A1 and A2. As such, it may be moved from the position illustrated in FIG. 2 to the position shown in FIG. 3. The movement may be a distance of from 2 to 3 feet, a distance insufficient to block aisle A3, but sufficient to permit access to the rear face 14A thereof for the loading of fresh or new merchandise. Loading from the rear will guarantee that merchandise (first-in merchandise) previously loaded will be presented to the customer before newly-loaded merchandise, assuring first-in, first-out selection.

As illustrated by FIGS. 2 and 3, the moveable display gondolas 12 may be moved from their positions of coincidence and alignment with the rear surfaces 10A of the fixed gondolas 10 to positions in which the rear surfaces 10A are fully exposed and accessible for loading of fresh or new merchandise. Loading from the rear will guarantee that merchandise previously loaded will be presented to the consumer before newly-loaded merchandise. The first moveable gondola 12 may be moved laterally and parallel to aisles A1 and A2 and into pocket 16. The other moveable gondolas 12 may be moved laterally and parallel to aisles A1 and A2 serially to expose the rear surfaces 10A of successive gondolas 10, also for loading from the rear, as described.

In this manner rear access is provided to each of the gondolas 10 and 14 for first-in and first-out presentation of merchandise to a customer.

Desirably, the gondolas 10 may be about 4 feet×4 feet in plan view, gondolas 12 may be about 4 feet×4 feet in plan view and gondolas 14 may be about 4 feet×18 inches in plan view. When used in heights of about 8 feet, and fully loaded with beverage containers, moveable gondola 14 may weight as much as 4800 pounds. Loading of typical gondolas 12 may be several thousand pounds or more. Gondolas 14 may be sectionalized to reduce the weight of the individual sections to facilitate their movement.

Figure 4:
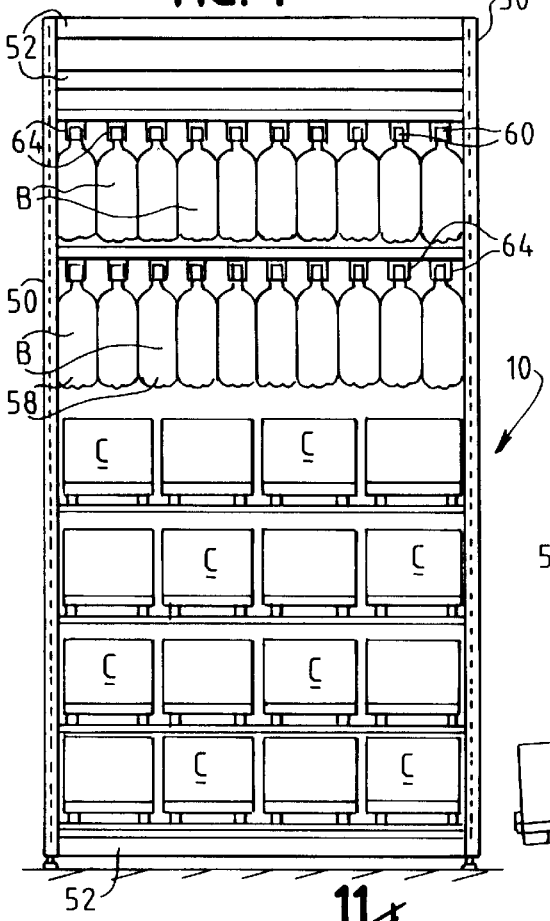
FIG. 4 is a front elevational view of a fixed storage and display gondola of FIG. 1.
Figure 5:
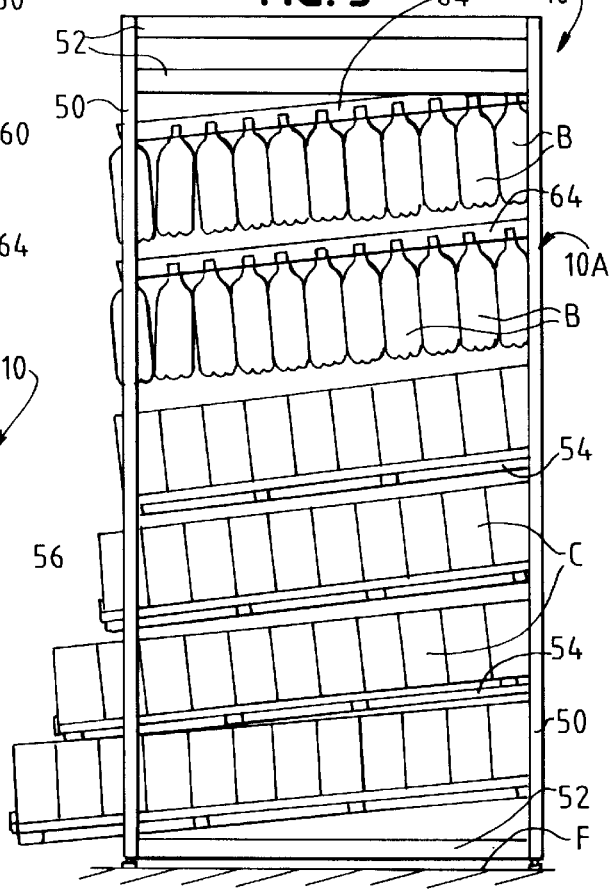
FIG. 5 is a side elevational view of a gondola of FIG. 4.

Referring now to FIGS. 4 and 5, a fixed display gondola 10 comprises suitable vertical standards or frame members 50 supported on floor F and transverse, lateral and angled frame members or struts 52, to secure, integrate and stabilize the standards 50, thereby to provide a stable, satisfactorily rigid assembly. The lower regions of the gondola 10 may be used to display cartons C of beverage containers, such as six-packs of cans, twelve-packs of cans, multi-pack cartons of bottles, etc.

Cartons C are supported on inclined shelves 54 which may comprise roller bearings upon which the cartons are seated. Because of their weight, the cartons C tend to move forwardly on the roller bearings until the forward-most ones of the cartons C engage a shelf stop or lip 56. To remove a carton, a consumer need only slightly elevate the carton C to be selected above a lip 56 and pull the carton C forward. The next succeeding carton C will then roll forwardly on the roller bearings until it is stopped by a confronting lip 56. As shown in FIGS. 4 and 5, the number of rows of cartons C may be four, although other rack widths and carton arrays may be used as well.

The upper regions of the gondola 10 are adapted for displaying and dispensing beverage containers, such as bottles B. The bottles B, in the exemplary embodiment, are shown as two-liter, carbonated beverage bottles comprising a conventional, plastic container 58 and an associated plastic closure 60 for sealingly closing the container. These containers may be viewed as having enlarged neck zones, in this case being provided by the closures, and in particular by an enlarged flange formed on the closure.

Closure 60 comprises a conventional internally threaded cap and an outwardly projecting circular flange. In one form, the container 58 may be of a conventionally used plastic material and the closure 60 may be formed of a conventionally used plastic material. A typical two-liter container is about 4 11/32 inches in diameter. The closure is about 1 3/16 inches in diameter and about 13/16 inches in height. The flange is about 1 7/16 inches in diameter and is about 1/16 inch thick. As is the conventional practice in manufacturing closures, the material of which the closure 60 is made is of sufficient strength and rigidity to easily support the weight of filled bottles B, as well as any shock loads and stresses placed on the closure 60 and the flange without damaging the closures or associated containers, or their sealed relationships.

The upper regions of the gondola 10 mount a series of parallel guide and supporting channels or rails 64 which incline forwardly and downwardly within the gondola 10. There may be two banks of rails 64, one above the other. The rails 64 may be adapted for supporting other like containers, such as, for example, one-half liter and three-liter containers.

Each rail 64 is adapted to be secured to the rack 10 by support formations. Each rail 64 comprises a top, integrally formed sides, and inwardly projecting bottom flanges 66. Flanges 66 are spaced apart a distance slightly greater than the diameter of the neck of the container below the threads of the container and immediately adjacent the flange of the closure 58. As such, bottles B may move easily from the rear of a rail 64 to the front of a rail 64 and along and relative to the flanges 66. For two-liter bottles, the distance between the confronting edges of flanges 66 is about 1.15 inches, the width of rails 64 is about 2.0 inches and the flanges 66 project inwardly about 0.43 inch from their sides.

The structure of gondola 10, the arrangement of the rails and their relationship with bottles B and the means for facilitating, dispensing and removal of the bottles B from the rails may be in accordance with the showings in U.S. application Ser. No. 09/049,798 filed Mar. 27, 1998, the disclosure of which is here incorporated by reference.

Figure 6:
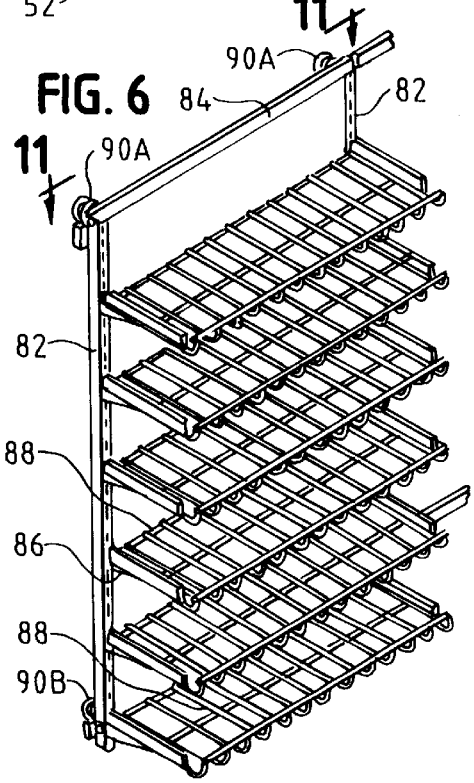
FIG. 6 is a top perspective view of a moveable storage and display gondola of FIG. 1.
Figure 5A:
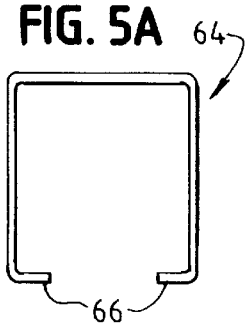
FIG. 5A is an enlarged front elevational view of a rail of the gondola of FIGS. 4 and 5.
Figure 7:
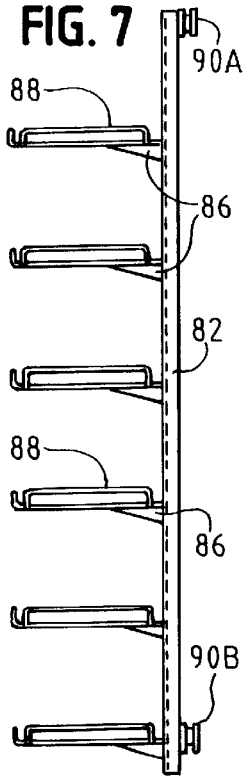
FIG. 7 is a side elevational view of FIG. 6.

Referring now to FIGS. 6 and 7, moveable storage and display gondolas 12 are seen to comprise a support structure which may comprise a backplate 80 and a pair of vertical standards or columns 82 secured thereto. Further rigidifying structure such as transverse header and footer plates or channels 84 may be employed as well. Standards 82 may define suitable slots for receiving hooked mounting brackets 86. Brackets 86 may be integrated with shelving such as open wire shelving 88, which is then suspended between spaced standards 82 for supporting goods to be merchandised and sold, such as potato chips, snacks, etc.

Gondolas 12 are mounted for movement between positions illustrated by FIG. 2 in which they mask and close off from view the rear surfaces 10A of associated gondolas 10 and positions in which they expose for access and use the rear surfaces of associated gondolas 10. To that end, the array 1 provides track and roller means mounted on and between gondolas 10 and 12 to provide a support, stabilization and guidance system for facilitating movement of gondolas 12. In that regard, in the embodiment of FIG. 1, the backplate 80 of gondola 12 mounts grooved rollers 90A, 90B. Rollers 90A, 90B are journalled for rotation on axles 92 and retained, as by lock pins 94. Preferably, pairs of upper rollers 90A and lower rollers 90B are disposed adjacent the opposite standards 82 to provide the greatest stability for a gondola 12 as it moves to expose and close off the rear surface of an associated gondola 10.

Figure 12:
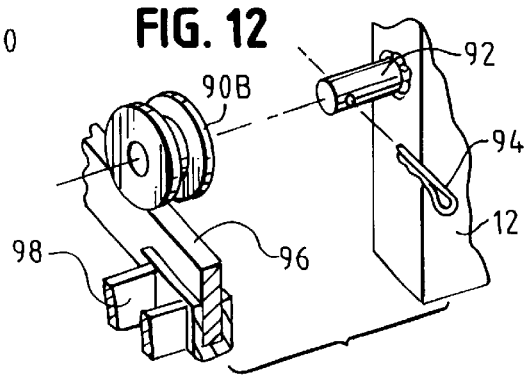
FIG. 12 is a fragmentary exploded perspective view of the support, stabilization and guidance system for reciprocating the gondola of FIG. 6.

Additionally, as best seen in FIG. 12, upper and lower tracks 96 which are proportioned to mate with and support rollers 90A, 90B are provided at or on the fixed gondolas 10. These may comprise structurally suitable, end supported plates as illustrated, mounted by spaced brackets 98, secured at the upper and lower regions of gondolas 10 and of any associated pocket 16, or may be modular, but spaced closely enough so that the gondolas 12 may transition easily between adjacent modular track segments.

Figure 10:
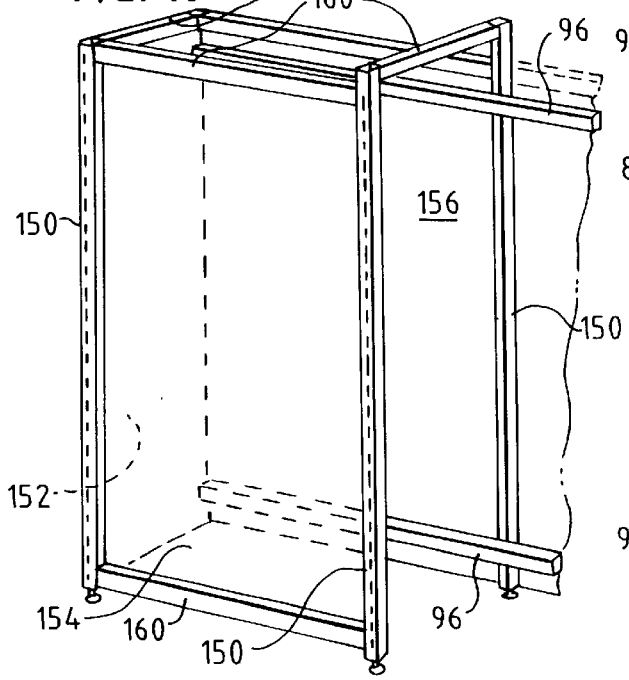
FIG. 10 is a rear perspective view, partially broken away, of the pocket of FIG. 1.
Figure 11:
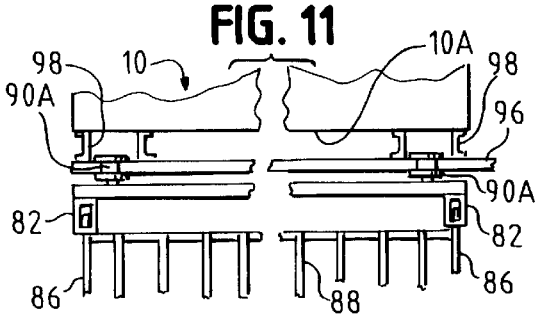
FIG. 11 is a fragmentary plan view of the support, stabilization and guidance system for reciprocating the gondola of FIG. 6 relative to a fixed gondola.

As shown by FIGS. 1, 2 and 10, pocket 16 is fixed and is located adjacent moveable gondola 10 when the array is in a customer use mode. Pocket 16 is hollow and comprises a plurality of vertical columns 150 and outer face panels, including front face panel 152 facing aisle A3 and side face panel 154 facing aisle A2. An inner panel 156 facing the side surface of gondola 14 is optional. Cross members 160 complete the structural array defining the pocket 16. Any cross-members 160 at the rear of the pocket (namely, the end at which moveable gondolas 14 temporarily enter the pocket 16) must be situated at an elevation which is higher than that of the top of the gondola 12 so that a gondola 12 may easily move along rails 96 into the pocket 16 to expose the rear surface of a fixed gondola 10. Preferably the width of the pocket 16 (the distance between spaced columns 150 is minimally greater than the depth of the adjacent moveable gondola 12 thereby to minimize the non-used floor space). The depth of the pocket 16 should also be the minimum necessary to receive a gondola 12 so that the entire rear surface of the adjacent fixed display gondola may be exposed and accessed to facilitate complete rear loading thereof.

Where desired, the outer face panel 154 may be omitted and a shelving assembly 155 substituted therefor or a shelving assembly 155 may simply be positioned against outer face panel 154. Such a shelving assembly may be mounted in any suitable fashion, such as via bracketed hooks inserted in the slotted standards 150 as in the manner described in connection with the shelving of gondola 12. Alternatively, side panel 154 may be decorated with suitable graphics, as may be front face panel 152.

Figure 8:
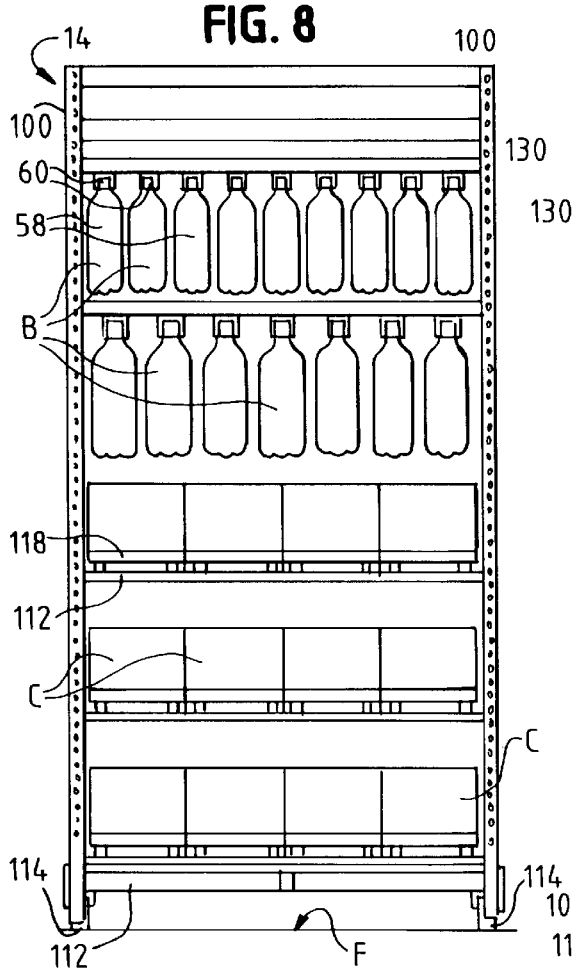
FIG. 8 is a front elevational view of a moveable gondola of FIG. 1.
Figure 9:
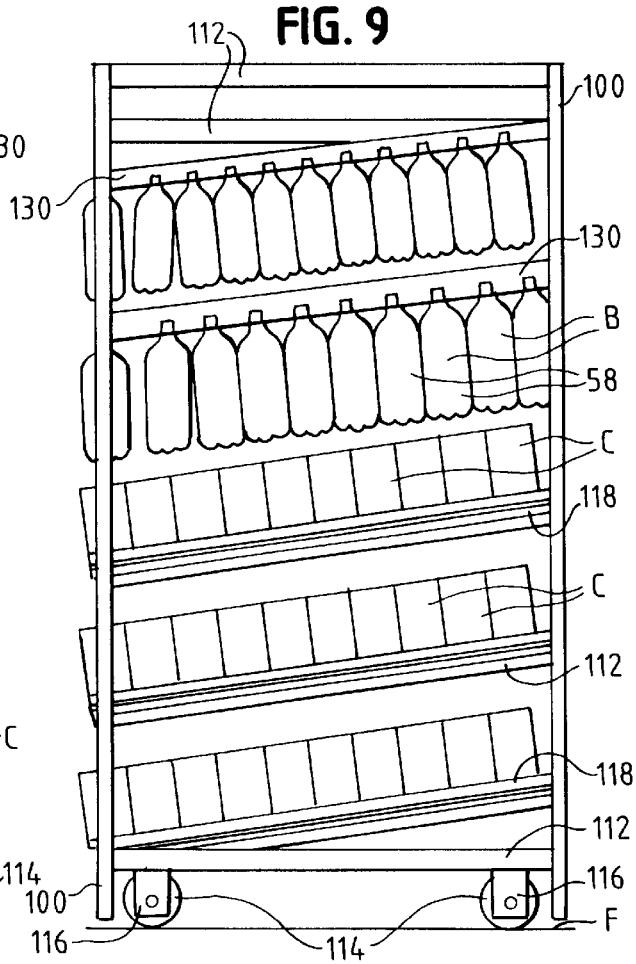
FIG. 9 is a side elevational view of FIG. 8.

Referring now to FIGS. 8 and 9, a moveable end gondola 14 comprises a generally rectilinear frame assembly comprising vertical standards or columns 100 which define a vertical pattern of keyhole shaped slots. The keyhole slots may be used to affix and mount display racks to provide a decorative and/or functional rack for goods to be sold. Lateral, transverse and angled struts 112 physically secure and stabilize the columns 100 of gondola 14. In its lower regions, gondola 14 is supported on the floor F on four casters 114, one at each corner. Casters 114 may be steel or may have rubber treads. They may roll on floor F or on plates or tracks mounted on floor F. They may be individually power assisted, as by drive motors. The casters are mounted on yokes 116 which in turn are secured to struts 112. Like gondola 12, gondola 14 also provides a series of shelves such as inclined shelves 118 on which merchandise such as cartons C of soft drink cans are displayed for purchase. Shelves 118 have upwardly projecting lips at the front to prevent the cartons from inadvertent ejection from the shelves. To remove a carton C, a customer needs only slightly elevate a carton C above the lip and pull the carton forwardly.

The upper regions of gondola 14 may be adapted for displaying and dispensing beverage containers, such as two-liter and three-liter carbonated beverage bottles B. Each bottle B may comprise a conventional, plastic container 58 and an associated plastic closure 60 for sealingly closing the container. These containers may have enlarged neck zones, such as by way of a conventional enlarged flange formed with the closure 60.

The upper regions of the gondola 14 mount a series of parallel guide and supporting channels or rails 130 which incline forwardly and downwardly within the gondola 14. Each rail 130 is adapted to be secured to the gondola 14 by suitable support formations, as in the manner in which rails 64 are secured.

Each rail 130 has inwardly projecting bottom flanges 132 which are spaced apart a distance slightly greater than the diameter of the neck of the container below the threads of the container and immediately adjacent the enlarged flange of the closure 60. As such, bottles B may move easily from the rear of a rail 130 to the front of a rail 130 and along and relative to the flanges 132. For two-liter bottles, the distance between the confronting edges of flanges 132 is about 1.15 inches, the width of rails 130 is about 2.0 inches and the flanges 132 project inwardly about 0.43 inch from their sides, as was the case with rails 64.

In the manner described, the array 1 makes it possible easily to assure first-in, first-out selection of merchandise by making it possible to load new merchandise from the rear of supermarket gondolas. This enhances the likelihood of keeping customers satisfied with the quality and consistency of the merchandise purchased, at a minimal expense to the vendor and vendor's suppliers who are usually required to do the restocking of merchandise, such as carbonated beverages and the like. Now stocking of goods requires no extra effort or special attention, contrary to the situation as it has existed to this time.

Figure 13:
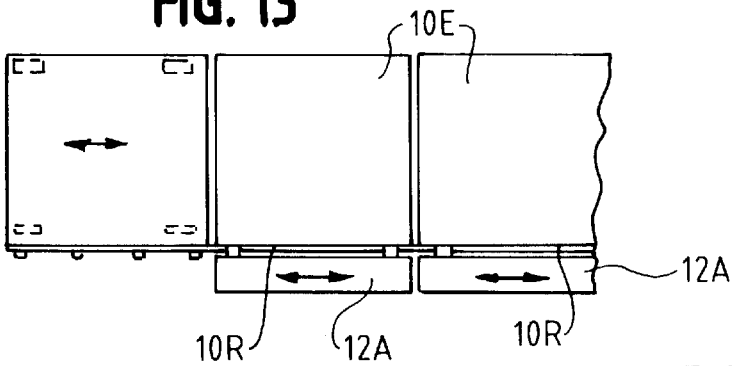
FIG. 13 is a view of a further embodiment of an in-store product display area like that of FIG. 2, but omitting a pocket.
Figure 14:
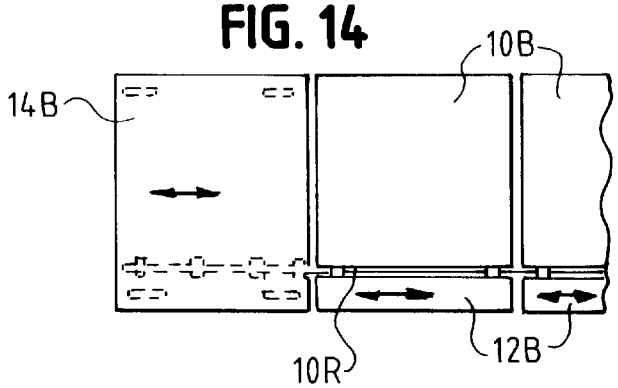
FIG. 14 is a view of another embodiment like those of FIG. 2 and FIG. 13, but omitting a pocket and employing a full width end cap gondola.

In the embodiment of FIGS. 1 and 2, the fixed gondolas 10 were associated with moveable gondolas 12 and moveable end cap gondola 14. A pocket 16 was provided to receive an adjacent moveable gondola 12. In the embodiment of FIGS. 13 and 14, there is no pocket, such as pocket 16. Instead, the space occupied by a pocket in FIG. 2 is left empty in FIG. 13. Temporary moveable display racks or the like could be positioned there if desired or, if the moveable gondolas 12A could be moved to the right to expose the rear surfaces 10R of gondolas 10E, the space occupied by the pocket 16 in FIG. 2 could be permanently filled with shelving or the like in the embodiment of FIG. 13.

In the embodiment of FIG. 14, the moveable end cap gondola 14B occupies the entire space formerly occupied by pocket 16 in FIG. 1. In this case, either the end cap gondolas 14B must be moved to permit movement of a gondola 12B to gain access to the rear surface 10R of the adjacent fixed gondola 10B or the array must permit the moveable gondolas 12B to move to the right as seen in FIG. 14 to expose the rear surface 10R of gondolas 10B for rear loading.

Figure 15:
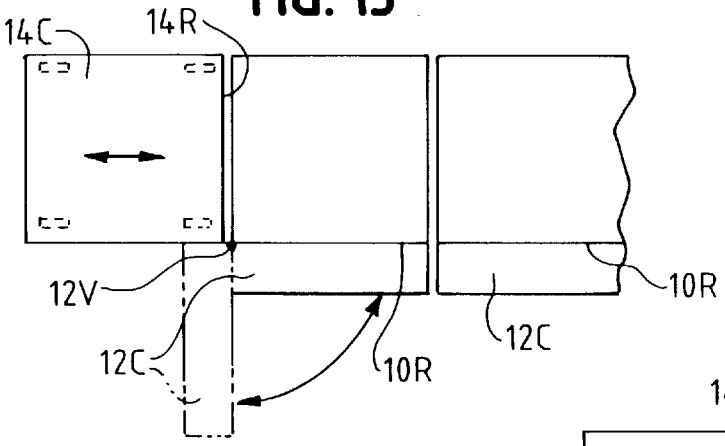
FIG. 15 is yet another embodiment of an in-store product area and end cap, but employing a moveable gondola which is pivotally mounted to expose the rear face of a fixed gondola for restocking from the rear.
Figure 16:
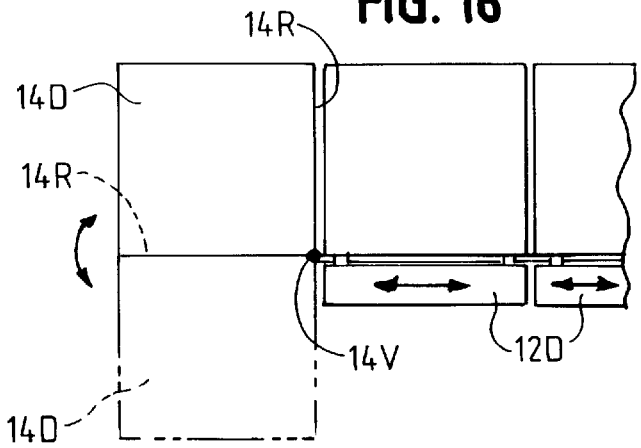
FIG. 16 is a still further embodiment, but employing a moveable end cap which is pivotally mounted to expose the rear face of the end cap for restocking from the rear.

Other alternatives for mounting an end cap gondola and moveable display gondolas for movement to gain access to the rear surfaces of fixed gondolas and the rear surface of an end cap gondola are shown in FIGS. 15 and 16. In FIG. 15, as was the case in FIG. 2, the end cap gondola 14C is reciprocable to permit access to its rear face 14R. However, the moveable display gondolas 12C are mounted on a vertical axis 12V at one corner so that the gondola 12C pivots between a rear surface covering position and a second dotted line position in which the rear surface 10R of the fixed gondola 10C is accessible for rear loading. In FIG. 16, the moveable display gondolas 12D are mounted for reciprocation, as was the case in the embodiment of FIG. 2. However, the end cap gondola 14D is mounted on a vertical axis at one corner so that the gondola 14D pivots between a position in which its rear face directly confronts the side surface of an adjacent fixed gondola 10D and another position in which its rear face 14D is fully exposed for rear loading (as shown by the dotted line position in FIG. 16).

For the foregoing, it will be apparent to those skilled in the art that further embodiments and modifications may be made without departing from the spirit and scope of the investigation. The scope of the invention is therefore to be determined from the appended claims.

What is claimed is:

1. An in-store product display area rack array located at the end of a row of display racks and positioned between a pair of first and second parallel aisles and a third end aisle transverse to said parallel aisles, said aisles being used by customers for selecting merchandise from the front surfaces of racks on opposite sides of the aisles, said display area rack array comprising a first fixed rack for storage and display of merchandise, said first rack having a front display surface facing a first aisle, a parallel rear surface adapted to be exposed to a second adjacent parallel aisle and side surfaces which are generally perpendicular to said rear and front surfaces, is a second end cap rack for storage and display of merchandise, said second rack being mounted adjacent to and moveable relative to said first rack, said second end cap rack having a front display face facing said third end aisle, said second end cap display rack having a rear face which is generally parallel to said third end aisle and which is parallel to and closely adjacent to one of the side surfaces of said first rack, said second end cap display rack being moveable between a first position in which said rear face and said one side surface of said first rack are closely adjacent and a second position in which said rear face and said one side surface are spaced apart a distance sufficient to allow a person to freely enter the space there-between and to load said second end cap rack with merchandise from said rear face, a third rack for storage and display of merchandise, said third rack being mounted adjacent to and moveable relative to said first rack, said third rack confronting the rear surface of said first rack and facing said second aisle and moveable away from said rear surface to expose said rear surface to allow a person to load said first rack with merchandise from the rear surface of said first rack, said three storage and display racks constituting a unitary rack array comprising a display area in a first display mode and defining an open loading area behind said end cap rack in a second loading mode.

2. An in-store product display area in accordance with claim 1, and further including means for mounting said second and third racks for movement in a direction parallel to said first and second aisles.

3. An in-store product display area in accordance with claim 1, and further including means for mounting said second and third racks for pivotal movement about corners of said second and third racks.

4. An in-store product display area in accordance with claim 1, and further including means for mounting at least one of said second and third racks for movement in a direction parallel to said first and second aisles.

5. An in-store product display area in accordance with claim 1, and wherein at least one of said moveable racks is supported on rollers supported on the floor of said display area.

6. An in-store product display area in accordance with claim 1, and wherein said display area rack array comprises a fixed pocket at the intersection of said third end aisle and one of said first and second aisles, said pocket being of a size proportioned to receive said third rack when it is moved to expose the rear surface of said first rack.

7. An in-store product display area in accordance with claim 1, including roller means mounting said first and third racks to each other, whereby a said third rack may roll from a first position confronting the rear surface of said first display rack to a second position in which said rear surface is exposed to the second aisle to permit loading of said first rack with merchandise from the rear surface thereof.

8. An in-store product display area in accordance with claim 7, and wherein display area rack array comprises a fixed pocket at the intersection of said third end aisle and said second aisle, said pocket being of a size adapted to receive said third rack when it is moved from said first position to said second position.

9. An in-store product display area in accordance with claim 1, and further comprising a plurality of said first fixed racks arrayed in a row, each having a said rear surface, and a plurality of said third moveable racks arrayed in a row for movement in a direction parallel to said rear surfaces of said first racks.

10. An in-store product display area in accordance with claim 1, and roller means mounted on said first and third racks for rollingly supporting said third racks on said first racks for rolling movement away from said first rack rear surfaces to expose said rear surfaces to allow loading of said first racks with goods from the rear surfaces of said first racks.

11. An in-store product display area in accordance with claim 10, and wherein said roller means comprise a track mounted on said first racks and rollers mounted on said third racks.

12. A display rack array positioned between first and second parallel aisles and a third end aisle transverse to said parallel aisles, said array comprising a first fixed rack for storage and display of merchandise, said first rack having a front display surface, a parallel rear surface, and side surfaces which are generally perpendicular to said rear and front surfaces, a second end cap rack for storage and display of merchandise, said second rack being mounted adjacent to and moveable relative to said first rack, said second end cap rack having a front display face and a rear face which is generally parallel to and closely adjacent to one of the side surfaces of said first rack, said second end cap rack being moveable between a first position in which said rear face and said one side surface are closely adjacent and a second position in which said rear face and said one side surface are spaced apart a distance sufficient to allow a person to freely enter a space opened there-between and to load said second end cap rack with merchandise from said rear face, a third rack for storage and display of merchandise, said third rack confronting the rear surface of said first rack and being mounted adjacent to and moveable relative to said first rack, said third rack being moveable away from said rear surface to expose said rear surface to allow a person to load said first rack with merchandise therefrom, a fixed pocket adjacent said second end cap rack and in line with said third rack and positioned to receive said third rack when it is moved to expose the rear surface of said first rack, said first, second and third racks and pocket constituting a unitary rack array in a first display mode and defining an open loading area behind said end cap rack in a second loading mode.

13. An in-store product display area in accordance with claim 12, and further including means for mounting said second and third racks for movement in directions parallel to said first and second aisles.

14. An in-store product display area in accordance with claim 12, and wherein said second end cap rack is supported on rollers supported on the floor of said display area.

15. An in-store product display area in accordance with claim 12, including roller means mounting said first and third racks to each other, whereby a said third rack may roll from a first position confronting the rear surface of said first display rack to a second position in which said rear surface is exposed to the second aisle to permit loading of said first rack with merchandise from the rear surface thereof.

16. An in-store product display area in accordance with claim 12, and further comprising a plurality of said first fixed racks arrayed in a row, each having a said rear surface, and a plurality of said third moveable racks arrayed in a row for movement in a direction parallel to said rear surfaces of said first racks.

17. An in-store product display area in accordance with claim 12, and roller means mounted on said first and third racks for rollingly supporting said third racks on said first racks for rolling movement away from said first rack rear surfaces to expose said rear surfaces to allow loading of said first racks with merchandise from the rear surfaces of said first racks.

18. An in-store product display area in accordance with claim 17, and wherein said roller means comprise a track mounted on said first racks and rollers mounted on said third racks.

* * * * *